US011696378B2

(12) United States Patent
Farran et al.

(10) Patent No.: US 11,696,378 B2
(45) Date of Patent: Jul. 4, 2023

(54) ELECTROLUMINESCENT CELLS

(71) Applicant: Hewlett-Packard Development Company, L.P., Spring, TX (US)

(72) Inventors: Samer Farran, Nes Ziona (IL); Yaron Grinwald, Nes Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/450,945

(22) Filed: Oct. 14, 2021

(65) Prior Publication Data

US 2023/0122096 A1 Apr. 20, 2023

(51) Int. Cl.

| | |
|---|---|
| ***H05B 33/28*** | (2006.01) |
| ***G03G 13/00*** | (2006.01) |
| ***G03G 5/05*** | (2006.01) |
| ***G03G 5/09*** | (2006.01) |

(52) U.S. Cl.

CPC ..... *H05B 33/28* (2013.01); *G03G 5/0528* (2013.01); *G03G 5/09* (2013.01); *G03G 13/00* (2013.01)

(58) Field of Classification Search

CPC ..... H05B 33/28

USPC ..... 313/503

See application file for complete search history.

(56) References Cited

U.S. PATENT DOCUMENTS

2012/0299462 A1* 11/2012 Shi ..... H05B 33/22 313/498
2016/0064682 A1* 3/2016 Yamae ..... H01L 51/5206 257/40
2019/0006614 A1* 1/2019 Kuroki ..... H05B 33/28
2019/0334055 A1* 10/2019 Chan ..... C23C 4/06

FOREIGN PATENT DOCUMENTS

WO 2021206722 10/2021

* cited by examiner

*Primary Examiner* — Christopher M Raabe
(74) *Attorney, Agent, or Firm* — HP Inc. Patent Department

(57) ABSTRACT

An electroluminescent cell can comprise a first electrode; a second electrode; and an electroluminescent layer disposed between the first electrode and the second electrode. The second electrode can comprise a light-transmitting electrode layer that can comprise electrically conductive regions interspersed by light-transmitting regions. The light-transmitting regions can have higher light-transmissivity than the electrically conductive regions.

18 Claims, 3 Drawing Sheets

ELECTROLUMINESCENT CELLS

BACKGROUND

Electroluminescent cells are electrochemical cells that can produce light when, for example, an electric field is applied across an electroluminescent layer. The electric field may be applied between electrodes placed on either side of the electroluminescent layer. One of the electrodes may be formed of a material that is light-transmitting to allow light produced by the electroluminescent component to be transmitted from the cell. An example of a light-transmitting material is indium tin oxide (ITO), which may be deposited on a clear substrate e.g. glass or polyethylene terephthalate.

DETAILED DESCRIPTION

Figure 1:
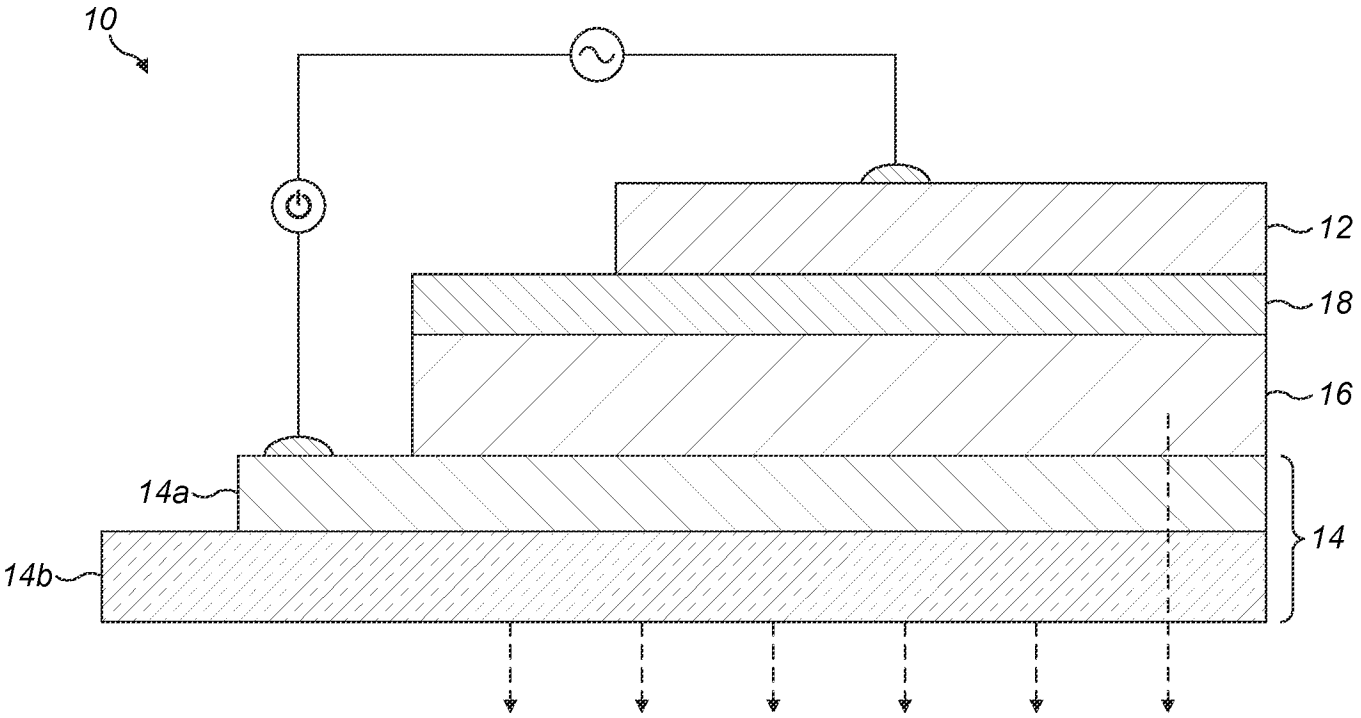
FIG. 1 is a schematic drawing of an example of a prior art electroluminescent cell.

In one aspect, the present disclosure provides an electroluminescent cell comprising a first electrode; a second electrode; and an electroluminescent layer disposed between the first electrode and the second electrode. The second electrode comprises a light-transmitting electrode layer that comprises electrically conductive regions interspersed by light-transmitting regions. The light-transmitting regions have higher light-transmissivity than the electrically conductive regions.

When a potential difference is applied across the electrodes of an electroluminescent cell, an electroluminescent layer between the electrodes produces light in response to the passing electric current or applied electric field. To allow the light produced to be transmitted from the cell, one of the electrodes of the electroluminescent cell may be formed of a light-transmitting material. An example of such a material is indium tin oxide (ITO). ITO-coated substrates (e.g. glass or polyethylene terephthalate) may be used as electrodes in electroluminescent cells to allow light generated to be transmitted from the cell. However, ITO-coated substrates can be costly to produce, for example, because of the vapour deposition techniques employed. This can add to the overall cost of the electroluminescent cell. Moreover, ITO-coated substrates cannot be produced by printing in-situ; accordingly, in some instances, their use can add to manufacturing complexity when producing printable electronics.

The electroluminescent cell of the present disclosure employs a light-transmitting electrode layer that comprises electrically conductive regions interspersed by light-transmitting regions. The light-transmitting regions have a higher light-transmissivity than the electrically conductive regions. Accordingly, more of the light generated by the electroluminescent layer is transmitted from the cell through the light-transmitting regions than through the electrically conductive regions. The light generated by the electroluminescent layer may be visible light. The visible light may have a wavelength of, for example, 380 to 750 nm or 380 to 700 nm. In some examples, more of the visible light produced by the electroluminescent layer will be transmitted through the light-transmitting regions than the electrically conductive regions. The light-transmitting regions can allow at least some light in the visible spectrum (380 to 750 nm) to pass therethrough, such that at least some of the visible light generated by the electroluminescent layer is visible through the light-transmitting regions of the second electrode.

In some examples, the light-transmitting regions may be optically transparent or optically translucent. The light-transmitting regions may transmit, for example, at least 50%, at least 60%, at least 70%, at least 80%, at least 85%, at least 90%, at least 95% or 100% of incident light (e.g. visible light) produced by the electroluminescent layer. In some examples, the light-transmitting regions are defined by apertures or voids in the electrode layer that allow light to pass therethrough. The light-transmitting regions defined by apertures or voids can transmit 100% of the light generated by the electroluminescent layer.

The electrically conductive regions, on the other hand, provide the electrode with electrical conductivity for the passage of electrical current. By passing an electrical current through the electrically conductive regions, an electric field may be applied across the electroluminescent layer.

The electrically conductive regions have lower light-transmissivity than the light-transmitting regions. In some examples, the electrically conductive regions are opaque. Accordingly, the electrically conductive regions can block at least some light in the visible spectrum (380 to 750 nm). The electrically conductive regions may have a non-transparent and/or non-translucent appearance.

The electrically conductive regions can be formed of e.g. opaque electrically conductive materials, such as metal or carbon pigments. Such pigments can be applied by printing, for example, electrophotographic printing. The electrically conductive pigments can be printed as an pattern of electrically conductive regions, whereby the space or voids between the electrically conductive regions provide the light-transmitting regions in the light-transmitting electrode layer. This allows a light-transmitting electrode layer to be produced using lower cost materials, reducing reliance on more costly light-transmitting electrodes, such as ITO-coated substrates.

Another aspect of the present disclosure provides a method of electrophotographically printing an electroluminescent cell. The method comprises disposing an electroluminescent layer over a first electrode, and forming a second electrode over the electroluminescent layer by electrophotographically printing an electrophotographic composition as a light-transmitting electrode layer. The electrophotographic composition is electrophotographically printed to form electrically conductive regions interspersed by light-transmitting regions, said light-transmitting regions having higher light transmissivity than the electrically conductive regions.

The electrically conductive regions may be formed by electrophotographic printing. As such, the electrically conductive regions may be formed from an electrophotographic composition. The electrically conductive regions may comprise thermoplastic polymer and electrically conductive pigment. The electrically conductive regions may further comprise charge director and/or charge adjuvant.

In some examples, the ratio of the total area of the light-transmitting regions to the total area of electrically conductive regions in the light-transmitting electrode layer may be at least 30%. The ratio of the total area of the light-transmitting regions to the total area of the light-transmitting electrode layer may be at least 40%, for example, at least 50%, at least 60%, at least 70%, at least 75%, at least 80%, at least 85%, at least 90%. The ratio of the total area of the light-transmitting regions to the total area of the light-transmitting electrode layer may be less than 100%, for example, less than 99%, less than 98%, or less than 97%. The extent of coverage, shape and/or configuration of the electrically conductive regions can be controlled depending on the desired current and/or electric field applied across the electroluminescent layer. The extent of coverage, shape and/or configuration of the electrically conductive regions can also be controlled depending on the desired amount of light transmission from the cell.

The ratio of the total area of the light-transmitting regions to the total area of the electrically conductive regions may be at least 40%, at least 100%, at least 300%, at least 500%, at least 700%, at least 800%, at least 900%, at least 1000%.

In some examples, the light-transmitting electrode layer comprises apertures that provide the light-transmitting regions. The apertures can act as windows in the light-transmitting electrode layer through which light can be transmitted. The apertures may measure at least 50 μm across, for example, at least 100 μm across, at least 200 μm across, at least 300 μm across, at least 400 μm across. The apertures may measure up to 2000 μm across, 1500 μm across, for example, up to 1200 μm across, up to 1000 μm across or up to 800 μm across. In some examples, the apertures may measure 50 to 2000 μm across, for instance, 100 to 1500 μm across, 200 to 1200 μm across, 300 to 1000 μm across or 400 to 800 across. In some examples, the apertures may measure 200 to 1000 μm across, for instance, 300 to 800 μm across.

In some examples, the electrically conductive regions may be printed as one or more electrically conductive pathways comprising electrically conductive pigment. The electrically conductive pathways may be interconnected. Space between the pathways can act as apertures that provide light-transmitting regions. These light-transmitting regions can occupy a sufficient proportion of the total area of the light-transmitting electrode layer so as to allow an sufficient proportion of light generated by the electroluminescent layer to be transmitted from the cell.

The pathways may be formed of printed lines of electrically conductive material. The pathways may be relatively fine or narrow. By printing the pathways as relatively narrow lines, the lines (at least in some examples) may not be so readily visible to the naked eye as to dominate the appearance of the second electrode. Accordingly, the second electrode may have a substantially clear appearance. The density, width and/or thickness of the pathways can also be varied to apply an adequate electric field across the electroluminescent layer for appropriate light generation.

The pathways may be at least 10 μm wide, for example, at least 20 μm wide, at least 30 μm wide, at least 40 μm wide, at least 50 μm wide, or at least 60 μm wide. The pathways may be at most 600 μm wide, at most 500 μm wide, at most 400 μm wide, at most 300 μm wide, at most 250 μm wide, at most 200 μm wide. In some examples, the pathways may be 10 to 600 μm wide, 20 to 500 μm wide, 30 to 400 μm wide, 40 to 300 μm wide, 50 to 250 μm wide or 60 to 200 μm wide.

In some examples, the light-transmitting electrode layer comprises a reticulated network of electrically conductive pathways, wherein the electrically conductive pathways provide the electrically conductive regions, and wherein space between the pathways define the apertures that provide the light-transmitting regions.

In some examples, the reticulated network may be a grid. The grid may comprise conductive pathways.

In some examples, the light-transmitting electrode layer comprises a criss-cross or intersecting pattern of electrically conductive pathways.

The conductive pathways may be interconnected in a grid or lattice pattern.

The pathways may be at least 10 μm wide, for example, at least 20 μm wide, at least 30 μm wide, at least 40 μm wide, at least 50 μm wide, or at least 60 μm wide. The pathways may be at most 600 μm wide, at most 500 μm wide, at most 400 μm wide, at most 300 μm wide, at most 250 μm wide, at most 200 μm wide. In some examples, the pathways may be 10 to 600 μm wide, 20 to 500 μm wide, 30 to 400 μm wide, 40 to 300 μm wide, 50 to 250 μm wide or 60 to 200 μm wide. The spacing between the pathways (e.g. voids or apertures) may measure at least 50 μm across, for example, at least 100 μm across, at least 200 μm across, at least 300 μm across, at least 400 μm across (e.g. at their widest point). The spacing between the pathways may measure up to 2000 μm across, 1500 μm across, for example, up to 1200 μm across, up to 1000 μm across or up to 800 μm across. In some examples, the spacing between the pathways may measure 50 to 2000 μm across, for instance, 100 to 1500 μm across, 200 to 1200 μm across, 300 to 1000 μm across or 400 to 800 μm across. In some examples, the spacing between the pathways may measure 200 to 1000 μm across, for instance, 300 to 800 μm across.

Each void may have an area of 2500 $\mu m^2$ to 4 $mm^2$, 10000 $\mu m^2$ to 2.25 $mm^2$, 40000 $\mu m^2$ to 1.5 $mm^2$, 90000 $\mu m^2$ to 1 $mm^2$ or 160000 $\mu m^2$ to 650,000 $\mu m^2$.

The thickness of the electrically conductive regions of the second electrode may be controlled by controlling the thickness of, for example, electrically conductive pigment applied. This may be controlled by varying the number of print passes.

The electrically conductive regions of the second electrode may be 1 to 50 μm thick, for example, 2 to 30 μm, 3 to 20 μm, 4 to 15 μm or 5 to 10 μm thick. The electrically conductive regions may be printed using 1 to 50 print passes, for example, 5 to 30 or 8 to 15 print passes.

The thickness, the area of coverage and/or configuration of the electrically conductive regions of the second electrode may affect the nature of the current and/or electric field applied to the electroluminescent layer. The thickness, area of coverage and/or configuration of the electrically conductive regions may be controlled by varying the print pattern of any electrically conductive pigment used to print the second electrode.

In some examples, the second electrode is in contact with the electroluminescent layer.

In some examples, to enhance the current and/or electric field applied to the electroluminescent layer, it may be possible to include a light-transmitting layer of conductive polymer in electrical contact with the second electrode. The layer of conductive polymer may underly the second electrode. The layer of conductive polymer may overly the electroluminescent layer. The layer of conductive polymer may be in direct contact with the electroluminescent layer and/or the second electrode. An example of a suitable layer of light-transmissive conductive polymer is an impurity-added poly(3,4-ethylenedioxythiophene) (PEDOT).

In some examples, the light-transmitting layer of conductive polymer may overly the second electrode. The light-transmitting layer of conductive polymer may be in contact with the second electrode. The layer of conductive polymer may be in direct contact with the second electrode. An example of a suitable layer of light-transmissive conductive polymer is an impurity-added poly(3,4-ethylenedioxythiophene) (PEDOT).

In some examples, the first electrode may be printed using an electrically conductive pigment. The first electrode may be printed by electrophotographic printing. The first electrode may comprise thermoplastic polymer and electrically conductive pigment. The first electrode may further comprise charge director and/or charge adjuvant. The electrically conductive pigment employed in the first electrode may be the same as the electrically conductive pigment employed to form the electrically conductive regions of the second electrode. The electrically conductive pigment employed in the first electrode may be different from the electrically conductive pigment employed to form the electrically conductive regions of the second electrode. The same electrophotographic composition may be used to print the first electrode and second electrode.

The thickness of the first electrode may be controlled by controlling the thickness of, for example, electrically conductive pigment applied. This may be controlled by varying the number of print passes.

The first electrode may be 1 to 100 μm thick, for example, 1 to 50 μm thick, 2 to 30 μm, 3 to 20 μm, 4 to 15 μm or 5 to 10 μm thick. The first electrode may be printed using 1 to 50 print passes, for example, 5 to 30 or 8 to 15 print passes.

The thickness, the area of coverage and/or configuration of the first electrode may affect the nature of the current and/or electric field applied to the electroluminescent layer. The thickness, area of coverage and/or configuration of the second electrode may be controlled by varying the print pattern of any electrically conductive pigment used to print the second electrode.

The first electrode may be printed as a layer of electrically conductive pigment. The first electrode may reflect light. In some examples, the first electrode may be a solid electrode.

The first electrode may directly or indirectly underly the electroluminescent layer. The first electrode may be printed on any suitable print substrate. For example, the first electrode may be printed on paper or cardboard.

In some examples, a dielectric layer disposed between the electroluminescent layer and the first electrode.

In some examples, the relative sizes and/or positions of the first and second electrodes may be adjusted to reduce the risk of direct contact between the first and second electrodes. This can help to ensure proper application of electric field across the electroluminescent layer when voltage is applied across the electrodes.

Electroluminescent Layer

The electroluminescent layer comprises an electroluminescent material. An electroluminescent material may emit light in response to an applied electric field or when an electrical current passes through it.

Any suitable electroluminescent material may be used. Examples include inorganic electroluminescent materials and organic electroluminescent materials.

Suitable inorganic electroluminescent materials may be selected from doped zinc sulfide, doped cadmium sulfide, semi-conductors comprising a Group III element and a Group V element (e.g. selected from indium phosphide, gallium arsenide and gallium nitride), and doped diamond. Where doped zinc sulfide and/or doped cadmium sulfide is employed, the doped zinc sulfide or doped cadmium sulfide may include a dopant, selected from copper, manganese, gold and silver. In some examples, zinc sulfide doped with copper and/or zinc sulfide doped with manganese is used. Doped zinc sulfide may further comprise a coactivator, e.g. a halide ion (e.g. selected from F, Cl, Br and I) and/or a trivalent ion (e.g. selected from Al, Ga and In). In some examples, zinc sulfide doped with copper and/or manganese is employed. Aluminium and/or chloride may be used as activators.

In some examples, organic electroluminescent material may be employed. Suitable organic electroluminescent material comprises a τ-conjugated polymer, e.g. a τ-conjugated polymer selected from polyfluorenes (e.g. poly(fluorene) itself), poly(1,4-phenylene), polyphenylene vinylenes, polyphenylene ethynylenes, poly(para-phenylene sulfide), polyvinyl carbazole, polythiophenes, polyphenylenes (e.g. poly(para-phenylenevinylene), polyanthracenes, polybenzothiadiazole, polybiothiophene and polyspiro compounds. A salt may be present with the organic electroluminescent material, e.g. the τ-conjugated polymer. The salt may be an inorganic or an organic salt. The organic salt may be selected from phosphonium salts, ammonium salts, pyridinium salts, imidazolium salts, and pyrrolidinium salts. The inorganic salts may comprise a cation and an anion, e.g. a cation selected from lithium cation, cesium cation, calcium cation, barium cation, rubidium cation, magnesium cation, sodium cation, potassium cation, imidazolium, pyridium, pyrrolidinium, pyrazolium, pyrazole, phosphonium, ammonium, guanidinium, uranium, thiouronium, sulfonium; and/or an anion selected from alkylsulfate, tosylate, methanesulfonate, trifluoromethanesulfonate, bis(trifluoromethylsulfonyl) imide, hexafluorophosphate, tetrafluoroborate, organoborate, thiocyanate, dicyanamide, and halides. An example of an organic electroluminescent material is [Ru(bpy)3]2+(PF6−)2, where bpy is 2,2'-bipyridine.

The electroluminescent layer as an electrophotographic composition. The electrophotographic composition used to form the electroluminescent layer may comprise particles of the electroluminescent material.

The electrophotographic composition used to form the electroluminescent layer may comprise 10 to 90 weight % electroluminescent material. For example, the electrophotographic composition may comprise 20 to 85 weight % electroluminescent material, for instance, 30 to 80 weight %, 40 to 75 weight % or 50 to 65 weight % electroluminescent material.

The particles of electroluminescent material may have a size, e.g. as determined from their largest dimension when viewed using scanning electron micrograph, of 1 to 50 microns, in some examples 5 to 40 microns, in some examples 5 to 35 microns, in some examples 5 to 25 microns, in some examples 10 to 35 microns, in some examples 10 to 40 microns, in some examples 20 to 30 microns, or in some examples 5 to 25 microns. The particles of the electroluminescent material may have a D50 of 1 to 50 microns, in some examples 5 to 40 microns, in some examples 5 to 30 microns, in some examples 10 to 40 microns, in some examples 10 to 35 microns, in some examples 20 to 30 microns, or in some examples 5 to 25 microns. D50 may be measured using, for example, any standard technique for particle size distribution, e.g. using wet classification, cyclone classification laser diffraction or sieving. D50 may be measured using laser diffraction with the particles in suspension, e.g. using a standard laser diffraction particle size analyser; the D50 may be the particle size at which the cumulative volume fraction of particles reaches 50%, e.g. as described in ISO 13320:2020.

The electrophotographic composition used to form the electroluminescent layer may also comprise thermoplastic polymer. The polymer may be a resin comprising a copolymer of copolymers of ethylene and an ethylenically unsaturated acid of either methacrylic acid or acrylic acid. Suitable thermoplastic polymers are described below.

The electrophotographic composition may also comprise charge adjuvant and/or charge director. Suitable charge adjuvants and charge directors are described below. The electrophotographic composition used to form the electroluminescent layer may also comprise a liquid carrier. Suitable liquid carriers are described below.

The electroluminescent material may be printed in the form of any pattern, for example, as words, logo or design. The pattern may light up on application of voltage across the electrodes of the cell.

Electrode

The first electrode and/or second electrode may be formed using an electrically conductive material. The electrically conductive material may be metal, carbon or conductive polymer.

Suitable metals may be in elemental or alloyed form. The metal may comprise group 2A, group 3A and/or transition metal. The metal may be selected from at least one of aluminum (Al), silver (Ag), gold (Au), platinum (Pt), tin (Sn), bismuth (Bi), copper (Cu), chromium (Cr), zinc (Zn), titanium (Ti), manganese (Mn), iron (Fe), nickel (Ni), rhodium (Rh) and iridium (Ir) and magnesium (Mg). In some examples, the metal may be copper (Cu) and/or silver (Ag).

Suitable conductive polymers may be selected from poly (fluorene), a polyphenylene, polypyrene, polyazulene, polynaphthalene, poly(acetylene), poly(p-phenylene vinylene), poly(pyrrole), polycarbazole, polyindole, polyazepines, polyaniline, poly(thiophene), poly(3,4-ethylenedioxythiophene), poly(p-phenylene sulfide), polythienylenevinylene and poly-1,6-heptadiyne.

Suitable forms of carbon include carbon nanotubes, graphene and/or graphite.

The first and/or second electrode may be printed using an electroconductive pigment. The electroconductive pigment may be metal, carbon or conductive polymer.

Suitable metals may be in elemental or alloyed form. The metal may comprise group 2A, group 3A and/or transition metal. The metal may be selected from aluminum (Al), silver (Ag), gold (Au), platinum (Pt), tin (Sn), bismuth (Bi), copper (Cu), chromium (Cr), zinc (Zn), titanium (Ti), manganese (Mn), iron (Fe), nickel (Ni), rhodium (Rh) and iridium (Ir) and magnesium (Mg). In some examples, the metal may be copper (Cu) and/or silver (Ag).

Suitable conductive polymers may be selected from poly (fluorene), a polyphenylene, polypyrene, polyazulene, polynaphthalene, poly(acetylene), poly(p-phenylene vinylene), poly(pyrrole), polycarbazole, polyindole, polyazepines, polyaniline, poly(thiophene), poly(3,4-ethylenedioxythiophene), poly(p-phenylene sulfide), polythienylenevinylene and poly-1,6-heptadiyne.

Suitable forms of carbon include carbon nanotubes, graphene and/or graphite.

An electrophotographic composition comprising the electrically conductive pigment may be used to form the first and/or second electrode. The same electrophotographic composition may be used to form the first electrode and the second electrode.

The electrophotographic composition used to form the electrodes may comprise 10 to 90 weight % electrically conductive pigment. For example, the electrophotographic composition may comprise 20 to 85 weight % electrically conductive pigment, for instance, 30 to 80 weight %, 40 to 75 weight % or 50 to 70 weight % electrically conductive pigment.

The electrically conductive pigment in the electrophotographic composition may be employed in the form of particles. The particles of electrically conductive pigment may have a size, e.g. as determined from their largest dimension when viewed using scanning electron micrograph, of 1 to 50 microns, in some examples 5 to 40 microns, in some examples 5 to 35 microns, in some examples 5 to 25 microns, in some examples 10 to 35 microns, in some examples 10 to 40 microns, in some examples 20 to 30 microns, or in some examples 5 to 25 microns. The particles of the electrically conductive pigment may have a D50 of 1 to 50 microns, in some examples 5 to 40 microns, in some examples 5 to 30 microns, in some examples 10 to 40 microns, in some examples 10 to 35 microns, in some examples 20 to 30 microns, or in some examples 5 to 25 microns. D50 may be measured using, for example, any standard technique for particle size distribution, e.g. using wet classification, cyclone classification laser diffraction or sieving. D50 may be measured using laser diffraction with the particles in suspension, e.g. using a standard laser diffraction particle size analyser; the D50 may be the particle size at which the cumulative volume fraction of particles reaches 50%, e.g. as described in ISO 13320:2020.

The electrophotographic composition used to form the first and/or second electrode may also comprise thermoplastic polymer. The polymer may be a resin comprising a co-polymer of copolymers of ethylene and an ethylenically unsaturated acid, for example, methacrylic acid and/or acrylic acid. In some examples, the resin comprises a copolymer of ethylene and methacrylic acid. In some examples, the resin comprises a copolymer of ethylene and acrylic acid. In some examples, a mixture of copolymers may be used. For example, the resin may comprise copolymers of ethylene and methacrylic acid, and copolymers of ethylene and acrylic acid.

Suitable thermoplastic polymers are described below. The same thermoplastic polymer may be used in the electrophotographic composition used to form the first and second electrode. The thermoplastic polymer employed used to form the first and/or second electrode may be the same or different from the that used in any other electrophotographic composition used in the formation of the cell. For example, the thermoplastic polymer employed may be the same or different from that used to form the electroluminescent layer and/or dielectric layer.

The electrophotographic composition may also comprise charge adjuvant and/or charge director. Suitable charge adjuvants and charge directors are described below. The same charge adjuvants and/or charge directors may be used to form the first electrode and second electrode. The charge director and/or charge adjuvant used to form the first and/or second electrode layer may be the same or different to the charge director(s) and/or charge adjuvant(s) used to form any other layer in the cell. For example, the charge adjuvant and/or charge director employed may be the same or different from those used to form the electroluminescent layer and/or dielectric layer (if present).

The electrophotographic composition used to form the electroluminescent layer may also comprise a liquid carrier. Suitable liquid carriers are described below. The same liquid carrier may be used to form the first electrode and second electrode. The liquid carrier used to form the first and/or second electrode layer may be the same or different to the carrier liquid used to form any other layer in the cell. For example, the carrier liquid may be the same or different from those used to form the electroluminescent layer and/or dielectric layer (if present).

Dielectric Material

In some examples, the electroluminescent cell further comprises dielectric material. The dielectric material can increase the effective capacitance by reducing the electric field strength. The dielectric material can create high amounts of charge through their surface hyperpolarizability as defined by their high dielectric constant. Creating this high level of surface charge can result in elevated levels of charge bouncing within the electroluminescent layer. This can result in an increased emission of light for a given level of voltage.

The dielectric material may be admixed with electroluminescent material in the electroluminescent layer. In some examples, a dielectric layer comprising dielectric material may be disposed between the electroluminescent layer, and the first and/or the second electrode. In some examples, the dielectric layer may be disposed between the first electrode and the electroluminescent layer. The dielectric layer may be in contact with the electroluminescent layer.

Any suitable dielectric material may be employed. The dielectric material may be opaque or transparent. Suitable dielectric material may be selected from a polymeric material, a ceramic material and a glass. In some examples, the dielectric material may be an opaque pigment. Any suitable pigments may be used, for example, white pigment. In some examples, the white pigment may comprise a material selected from TiO2, calcium carbonate, zinc oxide, barium titanate and mixtures thereof. In some examples, the dielectric material may be barium titanate and/or titanium dioxide. In some examples the pigment particle may comprise an alumina-TiO2 pigment. A form for the TiO2 may be selected from among rutile, anatase, brookite, and mixtures thereof, for example, the form may consist of rutile. The rutile form of TiO2 exhibits the highest refractive index among the other forms of TiO2 and the other listed pigments. Examples of pigment particles include Sachtleben R405 from Sachtleben, and Ti-Pure® R900 from DuPont The dielectric material may be applied by printing. For example, a dielectric layer may be printed over the first electrode to form a layer that underlies the electroluminescent layer. In some examples, the dielectric layer is printed using an electrophotographic composition.

The electrophotographic composition used to form the dielectric layer may comprise 10 to 90 weight % dielectric material. For example, the electrophotographic composition may comprise 20 to 85 weight % dielectric material, for instance, 30 to 80 weight %, 40 to 75 weight % or 50 to 70 weight % dielectric material.

The electrophotographic composition used to form the dielectric layer may also comprise thermoplastic polymer. The polymer may be a resin comprising a co-polymer of copolymers of ethylene and an ethylenically unsaturated acid of either methacrylic acid or acrylic acid. Suitable thermoplastic polymers are described below. The thermoplastic polymer employed in the electrophotographic composition used to form the dielectric layer may be the same or different from the that used in any other electrophotographic composition used in the formation of the cell. For example, the thermoplastic polymer employed in the electrophotographic composition used to form the dielectric layer may be the same or different from that used to form the second electrode, first electrode and/or electroluminescent layer.

The electrophotographic composition used to form the dielectric layer may also comprise charge adjuvant and/or charge director. Suitable charge adjuvants and charge directors are described below. The charge director and/or charge adjuvant used to form the dielectric layer may be the same or different to the charge director(s) and/or charge adjuvant (s) used to form any other layer in the cell. For example, the charge adjuvant and/or charge director employed in the electrophotographic composition used to form the dielectric layer may be the same or different from those used to form the second electrode, first electrode and/or electroluminescent layer.

The electrophotographic composition used to form the dielectric layer may also comprise a liquid carrier. Suitable liquid carriers are described below. The liquid carrier used to form the dielectric layer may be the same or different to the liquid carrier used to form any other layer in the cell. For example, the liquid carrier employed in the electrophotographic composition used to form the dielectric layer may be the same or different from the carrier used to form the electrophotographic composition for the second electrode, first electrode and/or electroluminescent layer.

Thermoplastic Polymer

As described above, the electrophotographic compositions that can be used to form the electroluminescent layer, first and/or second electrode, and dielectric layer (if present) may comprise a thermoplastic polymer.

The thermoplastic polymer can comprise a copolymer of an olefin and acrylic acid and/or methacrylic acid. In some examples, the thermoplastic polymer comprises a copolymer of an olefin and acrylic acid.

The thermoplastic polymer may be present in an amount of 1 to 50 weight % of the total weight of solids in the electrophotographic composition, for example, 1 to 40 weight %, 1 to 30 weight %, 1 to 20 weight % or 1 to 15 weight % of the total weight of solids in the electrophotographic composition.

In some examples, the polymer of the resin may be selected from ethylene or propylene acrylic acid co-polymers; ethylene or propylene methacrylic acid co-polymers; ethylene vinyl acetate co-polymers; co-polymers of ethylene or propylene (e.g., 80 wt % to 99.9 wt %), and alkyl (e.g., C1 to C5) ester of methacrylic or acrylic acid (e.g., 0.1 wt % to 20 wt %); co-polymers of ethylene (e.g., 80 wt % to 99.9 wt %), acrylic or methacrylic acid (e.g., 0.1 wt % to 20.0 wt %) and alkyl (e.g., C1 to C5) ester of methacrylic or acrylic acid (e.g., 0.1 wt % to 20 wt %); co-polymers of ethylene or propylene (e.g., 70 wt % to 99.9 wt %) and maleic anhydride (e.g., 0.1 wt % to 30 wt %); polyethylene; polystyrene; isotactic polypropylene (crystalline); co-polymers of ethylene ethylene ethyl acrylate; polyesters; polyvinyl toluene; polyamides; styrene/butadiene co-polymers; epoxy resins; acrylic resins (e.g., co-polymer of acrylic or methacrylic acid and at least one alkyl ester of acrylic or methacrylic acid wherein alkyl may have from 1 to about 20 carbon atoms, such as methyl methacrylate (e.g., 50% to 90%)/methacrylic acid (e.g., 0 wt % to 20 wt %)/ethylhexylacrylate (e.g., 10 wt % to 50 wt %)); ethylene-acrylate terpolymers: ethylene-acrylic esters-maleic anhydride (MAH) or glycidyl methacrylate (GMA) terpolymers; ethylene-acrylic acid ionomers and combinations thereof.

In some examples, the resin may comprise a polymer having acidic side groups. Examples of the polymer having acidic side groups will now be described. The polymer having acidic side groups may have an acidity of 50 mg KOH/g or more, in some examples an acidity of 60 mg KOH/g or more, in some examples an acidity of 70 mg KOH/g or more, in some examples an acidity of 80 mg KOH/g or more, in some examples an acidity of 90 mg KOH/g or more, in some examples an acidity of 100 mg KOH/g or more, in some examples an acidity of 105 mg KOH/g or more, in some examples 110 mg KOH/g or more, in some examples 115 mg KOH/g or more. The polymer having acidic side groups may have an acidity of 200 mg KOH/g or less, in some examples 190 mg or less, in some examples 180 mg or less, in some examples 130 mg KOH/g or less, in some examples 120 mg KOH/g or less. Acidity of a polymer, as measured in mg KOH/g can be measured using standard procedures known in the art, for example using the procedure described in ASTM D1386.

The resin may comprise a polymer, in some examples a polymer having acidic side groups, that has a melt flow rate of less than about 70 g/10 minutes, in some examples about 60 g/10 minutes or less, in some examples about 50 g/10 minutes or less, in some examples about 40 g/10 minutes or less, in some examples 30 g/10 minutes or less, in some examples 20 g/10 minutes or less, in some examples 10 g/10 minutes or less. In some examples, all polymers having acidic side groups and/or ester groups in the particles each individually have a melt flow rate of less than 90 g/10 minutes, 80 g/10 minutes or less, in some examples 80 g/10 minutes or less, in some examples 70 g/10 minutes or less, in some examples 70 g/10 minutes or less, in some examples 60 g/10 minutes or less.

The polymer having acidic side groups can have a melt flow rate of about 10 g/10 minutes to about 120 g/10 minutes, in some examples about 10 g/10 minutes to about 70 g/10 minutes, in some examples about 10 g/10 minutes to 40 g/10 minutes, in some examples 20 g/10 minutes to 30 g/10 minutes. The polymer having acidic side groups can have a melt flow rate of, in some examples, about 50 g/10 minutes to about 120 g/10 minutes, in some examples 60 g/10 minutes to about 100 g/10 minutes. The melt flow rate can be measured using standard procedures known in the art, for example as described in ASTM D1238.

The acidic side groups may be in free acid form or may be in the form of an anion and associated with counterion(s), such as metal counterions, e.g., a metal selected from the alkali metals, such as lithium, sodium and potassium, alkali earth metals, such as magnesium or calcium, and transition metals, such as zinc. The polymer having acidic sides groups can be selected from resins such as co-polymers of ethylene and an ethylenically unsaturated acid of either acrylic acid or methacrylic acid; and ionomers thereof, such as methacrylic acid and ethylene-acrylic or methacrylic acid co-polymers which are at least partially neutralized with metal ions (e.g., Zn, Na, Li) such as SURLYN® ionomers. The polymer comprising acidic side groups can be a co-polymer of ethylene and an ethylenically unsaturated acid of either acrylic or methacrylic acid, where the ethylenically unsaturated acid of either acrylic or methacrylic acid constitute from 5 wt % to about 25 wt % of the co-polymer, in some examples from 10 wt % to about 20 wt % of the co-polymer.

The resin may comprise two different polymers having acidic side groups. The two polymers having acidic side groups may have different acidities, which may fall within the ranges mentioned above. The resin may comprise a first polymer having acidic side groups that has an acidity of from 10 mg KOH/g to 110 mg KOH/g, in some examples 20 mg KOH/g to 110 mg KOH/g, in some examples 30 mg KOH/g to 110 mg KOH/g, in some examples 50 mg KOH/g to 110 mg KOH/g, and a second polymer having acidic side groups that has an acidity of 110 mg KOH/g to 130 mg KOH/g.

The resin may comprise two different polymers having acidic side groups: a first polymer having acidic side groups that has a melt flow rate of about 10 g/10 minutes to about 50 g/10 minutes and an acidity of from 10 mg KOH/g to 110 mg KOH/g, in some examples 20 mg KOH/g to 110 mg KOH/g, in some examples 30 mg KOH/g to 110 mg KOH/g, in some examples 50 mg KOH/g to 110 mg KOH/g, and a second polymer having acidic side groups that has a melt flow rate of about 50 g/10 minutes to about 120 g/10 minutes and an acidity of 110 mg KOH/g to 130 mg KOH/g. The first and second polymers may be absent of ester groups.

The ratio of the first polymer having acidic side groups to the second polymer having acidic side groups can be from about 10:1 to about 2:1. The ratio can be from about 6:1 to about 3:1, in some examples about 4:1.

The resin may comprise a polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; said polymer may be a polymer having acidic side groups as described herein. The resin may comprise a first polymer having a melt viscosity of 15000 poise or more, in some examples 20000 poise or more, in some examples 50000 poise or more, in some examples 70000 poise or more; and in some examples, the resin may comprise a second polymer having a melt viscosity less than the first polymer, in some examples a melt viscosity of 15000 poise or less, in some examples a melt viscosity of 10000 poise or less, in some examples 1000 poise or less, in some examples 100 poise or less, in some examples 50 poise or less, in some examples 10 poise or less. The resin may comprise a first polymer having a melt viscosity of more than 60000 poise, in some examples from 60000 poise to 100000 poise, in some examples from 65000 poise to 85000 poise; a second polymer having a melt viscosity of from 15000 poise to 40000 poise, in some examples 20000 poise to 30000 poise, and a third polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; an example of the first polymer is NUCREL® 960 (from DuPont), and example of the second polymer is NUCREL® 699 (from DuPont), and an example of the third polymer is A-C® 5120 or A-C® 5180 (from Honeywell). The first, second and third polymers may be polymers having acidic side groups as described herein. The melt viscosity can be measured using a rheometer, e.g., a commercially available AR-2000 Rheometer from Thermal Analysis Instruments, using the geometry of: 25 mm steel plate-standard steel parallel plate, and finding the plate over plate rheometry isotherm at 120° C., 0.01 hertz shear rate.

If the resin in electrophotographic composition comprises a single type of polymer, the polymer (excluding any other components of the electrophotographic composition) may have a melt viscosity of 6000 poise or more, in some examples a melt viscosity of 8000 poise or more, in some examples a melt viscosity of 10000 poise or more, in some examples a melt viscosity of 12000 poise or more. If the resin comprises a plurality of polymers all the polymers of the resin may together form a mixture (excluding any other components of the electrophotographic composition) that has a melt viscosity of 6000 poise or more, in some examples a melt viscosity of 8000 poise or more, in some examples a melt viscosity of 10000 poise or more, in some examples a melt viscosity of 12000 poise or more. Melt viscosity can be measured using standard techniques. The melt viscosity can be measured using a rheometer, e.g., a commercially available AR-2000 Rheometer from Thermal Analysis Instruments, using the geometry of: 25 mm steel plate-standard steel parallel plate, and finding the plate over plate rheometry isotherm at 120° C., 0.01 hertz shear rate.

The resin may comprise two different polymers having acidic side groups that are selected from co-polymers of ethylene and an ethylenically unsaturated acid of either acrylic acid or methacrylic acid; or ionomers thereof, such as methacrylic acid and ethylene-acrylic or methacrylic acid co-polymers which are at least partially neutralized with metal ions (e.g., Zn, Na, Li) such as SURLYN® ionomers. The resin may comprise (i) a first polymer that is a co-polymer of ethylene and an ethylenically unsaturated acid of either acrylic acid and methacrylic acid, wherein the ethylenically unsaturated acid of either acrylic or methacrylic acid constitutes from 8 wt % to about 16 wt % of the co-polymer, in some examples 10 wt % to 16 wt % of the co-polymer; and (ii) a second polymer that is a co-polymer of ethylene and an ethylenically unsaturated acid of either acrylic acid and methacrylic acid, wherein the ethylenically unsaturated acid of either acrylic or methacrylic acid constitutes from 12 wt % to about 30 wt % of the co-polymer, in some examples from 14 wt % to about 20 wt % of the co-polymer, in some examples from 16 wt % to about 20 wt % of the co-polymer in some examples from 17 wt % to 19 wt % of the co-polymer.

The resin may comprise a polymer having acidic side groups, as described above (which may be free of ester side groups), and a polymer having ester side groups. The polymer having ester side groups may be a thermoplastic polymer. The polymer having ester side groups may further comprise acidic side groups. The polymer having ester side groups may be a co-polymer of a monomer having ester side groups and a monomer having acidic side groups. The polymer may be a co-polymer of a monomer having ester side groups, a monomer having acidic side groups, and a monomer absent of any acidic and ester side groups. The monomer having ester side groups may be a monomer selected from esterified acrylic acid or esterified methacrylic acid. The monomer having acidic side groups may be a monomer selected from acrylic or methacrylic acid. The monomer absent of any acidic and ester side groups may be an alkylene monomer, including, but not limited to, ethylene or propylene. The esterified acrylic acid or esterified methacrylic acid may, respectively, be an alkyl ester of acrylic acid or an alkyl ester of methacrylic acid. The alkyl group in the alkyl ester of acrylic or methacrylic acid may be an alkyl group having 1 to 30 carbons, in some examples 1 to 20 carbons, in some examples 1 to 10 carbons; in some examples selected from methyl, ethyl, iso-propyl, n-propyl, t-butyl, iso-butyl, n-butyl and pentyl.

The polymer having ester side groups may be a co-polymer of a first monomer having ester side groups, a second monomer having acidic side groups and a third monomer which is an alkylene monomer absent of any acidic and ester side groups. The polymer having ester side groups may be a co-polymer of (i) a first monomer having ester side groups selected from esterified acrylic acid or esterified methacrylic acid, in some examples an alkyl ester of acrylic or methacrylic acid, (ii) a second monomer having acidic side groups selected from acrylic or methacrylic acid and (iii) a third monomer which is an alkylene monomer selected from ethylene and propylene. The first monomer may constitute 1% to 50% by weight of the co-polymer, in some examples 5% to 40% by weight, in some examples 5% to 20% by weight of the co-polymer, in some examples 5% to 15% by weight of the co-polymer. The second monomer may constitute 1% to 50% by weight of the co-polymer, in some examples 5% to 40% by weight of the co-polymer, in some examples 5% to 20% by weight of the co-polymer, in some examples 5% to 15% by weight of the co-polymer. The first monomer can constitute 5% to 40% by weight of the co-polymer, the second monomer constitutes 5% to 40% by weight of the co-polymer, and with the third monomer constituting the remaining weight of the co-polymer. In some examples, the first monomer constitutes 5% to 15% by weight of the co-polymer, the second monomer constitutes 5% to 15% by weight of the co-polymer, with the third monomer constituting the remaining weight of the co-polymer. In some examples, the first monomer constitutes 8% to 12% by weight of the co-polymer, the second monomer constitutes 8% to 12% by weight of the co-polymer, with the third monomer constituting the remaining weight of the co-polymer. In some examples, the first monomer constitutes about 10% by weight of the co-polymer, the second monomer constitutes about 10% by weight of the co-polymer, and with the third monomer constituting the remaining weight of the co-polymer. The polymer may be selected from the BYNEL® class of monomer, including BYNEL® 2022 and BYNEL® 2002, which are available from DuPont®.

The polymer having ester side groups may constitute 1% or more by weight of the total amount of the resin polymers, e.g., thermoplastic resin polymers, in the electrophotographic composition and/or the ink printed on the print substrate, e.g., the total amount of the polymer or polymers having acidic side groups and polymer having ester side groups. The polymer having ester side groups may constitute 5% or more by weight of the total amount of the resin polymers, e.g., thermoplastic resin polymers, in some examples 8% or more by weight of the total amount of the resin polymers, e.g., thermoplastic resin polymers, in some examples 10% or more by weight of the total amount of the resin polymers, e.g., thermoplastic resin polymers, in some examples 15% or more by weight of the total amount of the resin polymers, e.g., thermoplastic resin polymers, in some examples 20% or more by weight of the total amount of the resin polymers, e.g., thermoplastic resin polymers, in some examples 25% or more by weight of the total amount of the resin polymers, e.g., thermoplastic resin polymers, in some examples 30% or more by weight of the total amount of the resin polymers, e.g., thermoplastic resin polymers, in some examples 35% or more by weight of the total amount of the resin polymers, e.g., thermoplastic resin polymers, in the electrophotographic composition and/or the printed on the print substrate. The polymer having ester side groups may constitute from 5% to 50% by weight of the total amount of the resin polymers, e.g., thermoplastic resin polymers, in the electrophotographic composition and/or the ink printed on the print substrate, in some examples 10% to 40% by weight of the total amount of the resin polymers, e.g., thermoplastic resin polymers, in the electrophotographic composition and/or the ink printed on the print substrate, in some examples 5% to 30% by weight of the total amount of the resin polymers, e.g., thermoplastic resin polymers, in the electrophotographic composition and/or the ink printed on the print substrate, in some examples 5% to 15% by weight of the total amount of the resin polymers, e.g., thermoplastic resin polymers, in the electrophotographic composition and/or the ink printed on the print substrate in some examples 15% to 30% by weight of the total amount of the resin polymers, e.g., thermoplastic resin polymers, in the electrophotographic composition and/or the ink printed on the print substrate.

The polymer having ester side groups may have an acidity of 50 mg KOH/g or more, in some examples an acidity of 60 mg KOH/g or more, in some examples an acidity of 70 mg KOH/g or more, in some examples an acidity of 80 mg KOH/g or more. The polymer having ester side groups may have an acidity of 100 mg KOH/g or less, in some examples 90 mg KOH/g or less. The polymer having ester side groups may have an acidity of 60 mg KOH/g to 90 mg KOH/g, in some examples 70 mg KOH/g to 80 mg KOH/g.

The polymer having ester side groups may have a melt flow rate of about 10 g/10 minutes to about 120 g/10 minutes, in some examples about 10 g/10 minutes to about 50 g/10 minutes, in some examples about 20 g/10 minutes to about 40 g/10 minutes, in some examples about 25 g/10 minutes to about 35 g/10 minutes.

The polymer, polymers, co-polymer or co-polymers of the resin can in some examples be selected from the NUCREL® family of toners (e.g., NUCREL® 403, NUCREL® 407, NUCREL® 609HS, NUCREL®908HS, NUCREL® 1202HC, NUCREL® 30707, NUCREL® 1214, NUCREL® 903, NUCREL® 3990, NUCREL® 910, NUCREL® 925, NUCREL® 699, NUCREL® 599, NUCREL® 960, NUCREL® RX 76, NUCREL® 2806, BYNEL® 2002, BYNEL® 2014, and BYNEL® 2020 (sold by E. I. du PONT)), the ACLYN® family of toners (e.g., ACLYN® 201, ACLYN® 246, ACLYN® 285, and ACLYN® 295), and the LOTADER® family of toners (e.g., LOTADER® 2210, LOTADER® 3430, and LOTADER® 8200 (sold by Arkema)).

The thermoplastic resin can, in some examples is present in the electrophotographic composition in an amount of from about 1 to about 70 wt % based on the total weight of the electrophotographic composition, or from about 1 to about 60 wt % based on the total weight of the electrophotographic composition, or from about 1 to about 50 wt % based on the total weight of the electrophotographic composition, or from about 1 to about 40 wt % based on the total weight of the electrophotographic composition, or from about 1 to about 30 wt % based on the total weight of the electrophotographic composition, or from about 1 to about 20 wt % based on the total weight of the electrophotographic composition, or from about 5 to about 15 wt % based on the total weight of the electrophotographic composition.

In some examples, the resin constitutes less than 1 wt % by weight of the solids printed on the electrophotographic composition, e.g., after heating, and/or rubbing, and/or plasma treatment.

In some examples, a polymerised rosin may also be present in the electrophotographic composition.

As used herein, "resin," "polymer," "thermoplastic resin," or "thermoplastic polymer" are used interchangeably.

Charge Adjuvant

As described above, the electrophotographic compositions that can be used to form the electroluminescent layer, first and/or second electrode, and dielectric layer (if present) may comprise a charge adjuvant. The charge adjuvant may adsorb onto the printable particles (toner particles) in the electrophotographic composition. A charge adjuvant may be present with or without a charge director, and may be different to the charge director, and act to increase and/or stabilise the charge on particles, e.g. resin-containing particles, of an electrophotographic composition.

The charge adjuvant can include, but is not limited to, barium petronate, calcium petronate, Co salts of naphthenic acid, Ca salts of naphthenic acid, Cu salts of naphthenic acid, Mn salts of naphthenic acid, Ni salts of naphthenic acid, Zn salts of naphthenic acid, Fe salts of naphthenic acid, Ba salts of stearic acid, Co salts of stearic acid, Pb salts of stearic acid, Zn salts of stearic acid, Al salts of stearic acid, Cu salts of stearic acid, Fe salts of stearic acid, metal carboxylates (e.g. Al tristearate, Al octanoate, Li heptanoate, Fe stearate, Fe distearate, Ba stearate, Cr stearate, Mg octanoate, Ca stearate, Fe naphthenate, Zn naphthenate, Mn heptanoate, Zn heptanoate, Ba octanoate, Al octanoate, Co octanoate, Mn octanoate, and Zn octanoate), Co lineolates, Mn lineolates, Pb lineolates, Zn lineolates, Ca oleates, Co oleates, Zn palmirate, Ca resinates, Co resinates, Mn resinates, Pb resinates, Zn resinates, AB diblock co-polymers of 2-ethylhexyl methacrylate-co-methacrylic acid calcium, and ammonium salts, co-polymers of an alkyl acrylamidoglycolate alkyl ether (e.g. methyl acrylamidoglycolate methyl ether-co-vinyl acetate), and hydroxy bis(3,5-di-tert-butyl salicylic) aluminate monohydrate. In some examples, the charge adjuvant is aluminium di and/or tristearate and/or aluminium di and/or tripalmitate.

The charge adjuvant can constitute about 0.1 to 5% by weight of the solids of the electrophotographic composition. The charge adjuvant can constitute about 0.5 to 4% by weight of the solids of the liquid electrophotographic composition. The charge adjuvant can constitute about 1 to 3% by weight of the solids of the electrophotographic composition.

Charge Director

As described above, the electrophotographic compositions that can be used to form the electroluminescent layer, first and/or second electrode, and dielectric layer (if present) may comprise charge director.

In some examples, the charge director comprises nanoparticles of a simple salt and a salt of the general formula $MA_n$, wherein M is a barium, n is 2, and A is an ion of the general formula $[R_1—O—C(O)CH_2CH(SO_3^-)C(O)—O—R_2]$, where each of $R_1$ and $R_2$ is an alkyl group e.g. as discussed above.

The sulfosuccinate salt of the general formula $MA_n$ is an example of a micelle forming salt. The charge director may be substantially free or free of an acid of the general formula HA, where A is as described above. The charge director may comprise micelles of said sulfosuccinate salt enclosing at least some of the nanoparticles. The charge director may comprise at least some nanoparticles having a size of 10 nm or less, in some examples 2 nm or more (e.g. 4-6 nm).

The simple salt may comprise a cation selected from Mg, Ca, Ba, $NH_4$, tert-butyl ammonium, $Li^+$, and $Al^{+3}$, or from any sub-group thereof. In one example, the simple salt is an inorganic salt, for instance, a barium salt. The simple salt may comprise an anion selected from $SO_4^{2-}$, $PO^{3-}$, $NO_3^-$, $HPO_4^{2-}$, $CO_3^{2-}$, acetate, trifluoroacetate (TFA), $Cl^-$, Bf, $F^-$, $ClO_4^-$, and $TiO_3^{4-}$, or from any sub-group thereof. In some examples, the simple salt comprises a hydrogen phosphate anion.

The simple salt may be selected from $CaCO_3$, $Ba_2TiO_3$, $Al_2(SO_4)_3$, $Al(NO_3)_3$, $Ca_3(PO_4)_2$, $BaSO_4$, $BaHPO_4$, $Ba_2(PO_4)_3$, $CaSO_4$, $(NH_4)_2CO_3$, $(NH_4)_2SO_4$, $NH_4OAc$, Tert-butyl ammonium bromide, $NH_4NO_3$, LiTFA, $Al_2(SO_4)_3$, $LiClO_4$ and $LiBF_4$, or any sub-group thereof. In one example, the simple salt may be $BaHPO_4$.

In the formula $[R_1—O—C(O)CH_2CH(SO_3^-)C(O)—O—R_2]$, in some examples, each of $R_1$ and $R_2$ is an aliphatic alkyl group. In some examples, each of $R_1$ and $R_2$ independently is a $C_{6-25}$ alkyl. In some examples, said aliphatic alkyl group is linear. In some examples, said aliphatic alkyl group is branched. In some examples, said aliphatic alkyl group includes a linear chain of more than 6 carbon atoms. In some examples, $R_1$ and $R_2$ are the same. In some examples, at least one of $R_1$ and $R_2$ is $C_{13}H_{27}$.

The charge director can constitute about 0.001% to 20%, in some examples 0.01 to 20% by weight, in some examples 0.01 to 10% by weight, in some examples 0.01 to 1% by weight of the solids of the composition. The charge director can constitute about 0.001 to 0.15% by weight of the solids of the composition, in some examples 0.001 to 0.15%, in some examples 0.001 to 0.02% by weight of the solids of the composition. In some examples, the charge director imparts a negative charge on the electrophotographic composition. The particle conductivity may range from 50 to 500 pmho/cm, in some examples from 200-350 pmho/cm.

Liquid Carrier

The electrophotographic compositions that can be used to form the electroluminescent layer, first and/or second electrode, and dielectric layer (if present) may be liquid electrophotographic compositions. The liquid electrophotographic compositions comprise a liquid carrier.

The liquid carrier can act as a dispersing medium for the other components in the electrophotographic composition. For example, the liquid carrier can comprise or be a hydrocarbon, silicone oil, vegetable nil, or combination thereof. The liquid carrier can include, but is not limited to, an insulating, non-polar, non-aqueous liquid that can be used as a medium for toner particles, e.g., the particles containing the resin and the metal or metal alloy pigment(s).

The liquid carrier can include compounds that have a resistivity in excess of about $10^9$ ohm-cm. The liquid carrier may have a dielectric constant below about 5, in some examples below about 3. The liquid carrier can include, but is not limited to, hydrocarbons. The hydrocarbon can include, but is not limited to, an aliphatic hydrocarbon, an isomerized aliphatic hydrocarbon, branched chain aliphatic hydrocarbons, aromatic hydrocarbons, and combinations thereof.

Examples of the liquid carriers include, but are not limited to, aliphatic hydrocarbons, isoparaffinic compounds, paraffinic compounds, dearomatized hydrocarbon compounds, and the like. In particular, the liquid carriers can include, but are not limited to, Isopar-G™, Isopar-H™, Isopar-L™, Isopar-M™, Isopar-K™, Isopar-V™, Norpar 12™, Norpar 13™, Norpar 15™, Exxol D40™, Exxol D80™, Exxol D100™, Exxol D130™, and Exxol D140™ (each sold by EXXON CORPORATION); Teclen N-16™, Teclen N-20™, Teclen N-22™, Nisseki Naphthesol L™, Nisseki Naphthesol M™, Nisseki Naphthesol H™, #0 Solvent L™, #0 Solvent M™, #0 Solvent H™, Nisseki Isosol 300™, Nisseki Isosol 400™, AF-4™, AF-5™, AF-6™ and AF-7™ (each sold by NIPPON OIL CORPORATION); IP Solvent 1620™ and IP Solvent 2028™ (each sold by IDEMITSU PETROCHEMICAL CO., LTD.); Amsco OMS™ and Amsco 460™ (each sold by AMERICAN MINERAL SPIRITS CORP.); and Electron, Positron, New II, Purogen HF (100% synthetic terpenes) (sold by ECOLINK™).

In some examples, the liquid carrier can constitute about 20% to 99.5% by weight of the electrophotographic composition, in some examples 50% to 99.5% by weight of the electrophotographic composition. The liquid carrier may constitute about 40 to 90% by weight of the electrophotographic composition. The liquid carrier may constitute about 60% to 80% by weight of the electrophotographic composition. The liquid carrier may constitute about 90% to 99.5% by weight of the electrophotographic composition, in some examples 95% to 99% by weight of the electrophotographic composition.

The ink, when printed on the print substrate, may be substantially free from liquid carrier. In an electrophotographic printing process and/or afterwards, the liquid carrier may be removed, e.g., by an electrophoresis processes during printing and/or evaporation, such that substantially just solids are transferred to the print substrate. Substantially free from liquid carrier may indicate that the ink printed on the print substrate contains less than 5 wt % liquid carrier, or less than 2 wt % liquid carrier, or less than 1 wt % liquid carrier, or less than 0.5 wt % liquid carrier, or less than 0.1 wt % liquid carrier. In some examples, the ink printed on the print substrate is free from liquid carrier.

Figures

FIG. 1 is a schematic drawing of an example of a prior art electroluminescent cell. The cell 10 comprises a first electrode 12, a second electrode 14 and an electroluminescent layer 16 disposed between the first electrode 12 and second electrode 14. A dielectric layer 18 is disposed between the first electrode 12 and the electroluminescent layer 18. When the electrodes are connected to e.g. an AC source, an electric field is applied across the electroluminescent layer 16. This causes the electroluminescent material within the layer to emit light.

The second electrode 14 is light-transmitting and allows light generated by the electroluminescent layer 16 to be transmitted from the cell 10 as shown schematically by the arrows in FIG. 1. The second electrode is formed of indium tin oxide (ITO), which forms an optically transparent and electrically conductive electrode layer 14*a* on an optically transparent substrate 14*b* (e.g. glass or polyethylene terephthalate). The optical transparency of the ITO layer and underlying substrate allows light to be transmitted through the second electrode 14.

It may be possible to form the electroluminescent layer 16, the dielectric layer 18 and the first electrode 12 by printing (e.g. electrophotographic printing). However, to date, it has not been possible to produce ITO films by printing. This requires the ITO-coated substrate to be sourced separately, adding to production costs and/or complexity.

Figure 2:
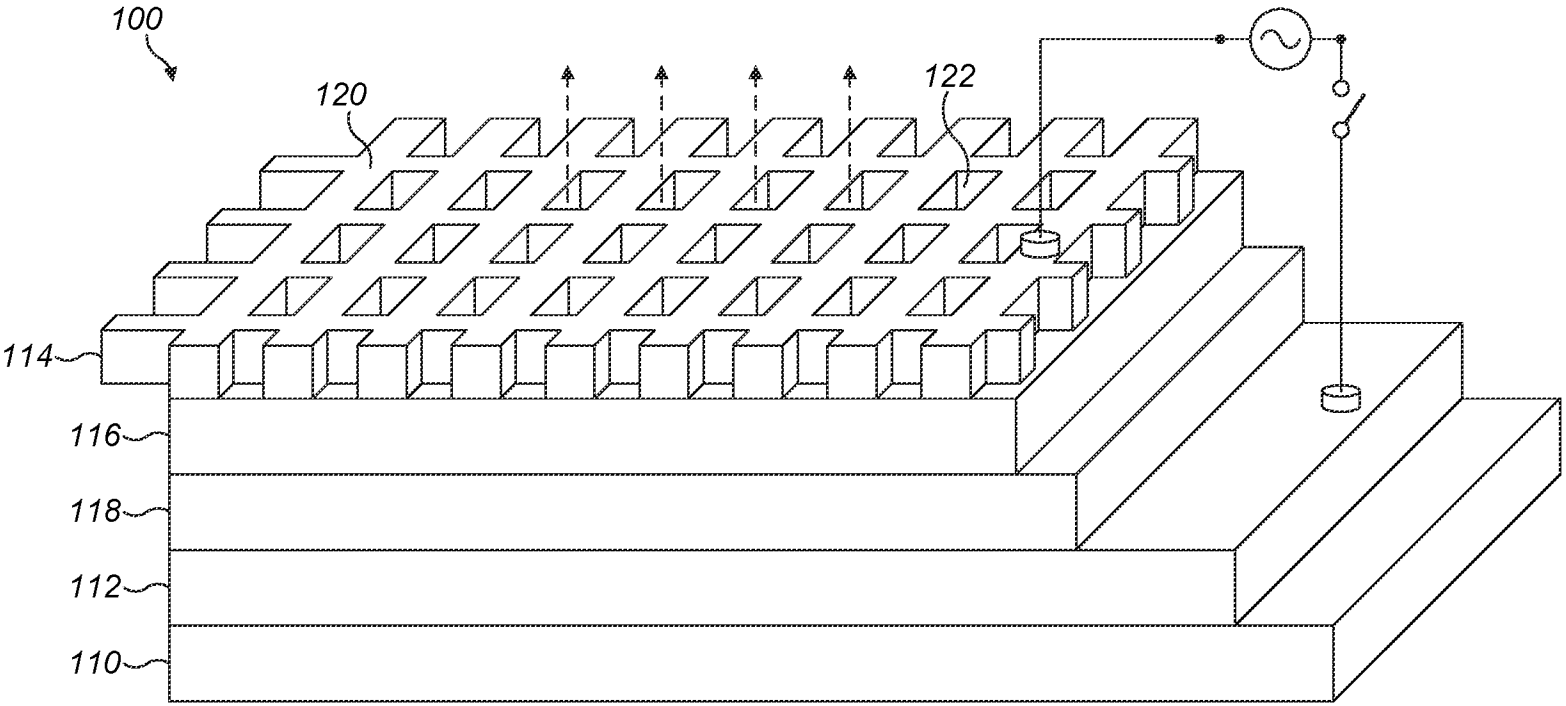
FIG. 2 is a schematic drawing of an example of an electroluminescent cell according to an example of the present disclosure.

FIG. 2 is a schematic drawing of an example of an electroluminescent cell according to an example of the present disclosure. The electroluminescent cell 100 comprises a first electrode 112, a second electrode 114 and an electroluminescent layer 116 disposed between the first electrode 112 and second electrode 114. A dielectric layer 118 is disposed between the first electrode 112 and the electroluminescent layer 118. When the electrodes are connected to e.g. an AC source, an electric field is applied across the electroluminescent layer 116. This causes the electroluminescent material within the layer to emit light.

The second electrode 114 is a light-transmitting electrode layer that comprises electrically conductive regions 120 interspersed by light-transmitting regions 122. The light-transmitting regions 122 have higher light-transmissivity than the electrically conductive regions 120. The light-transmitting regions 122 may be defined by apertures or voids in the light-transmitting electrode layer. Light from the electroluminescent layer 118 can pass through the apertures or voids, allowing light to be transmitted from the cell (illustrated by dotted arrows in FIG. 2).

Figure 3:
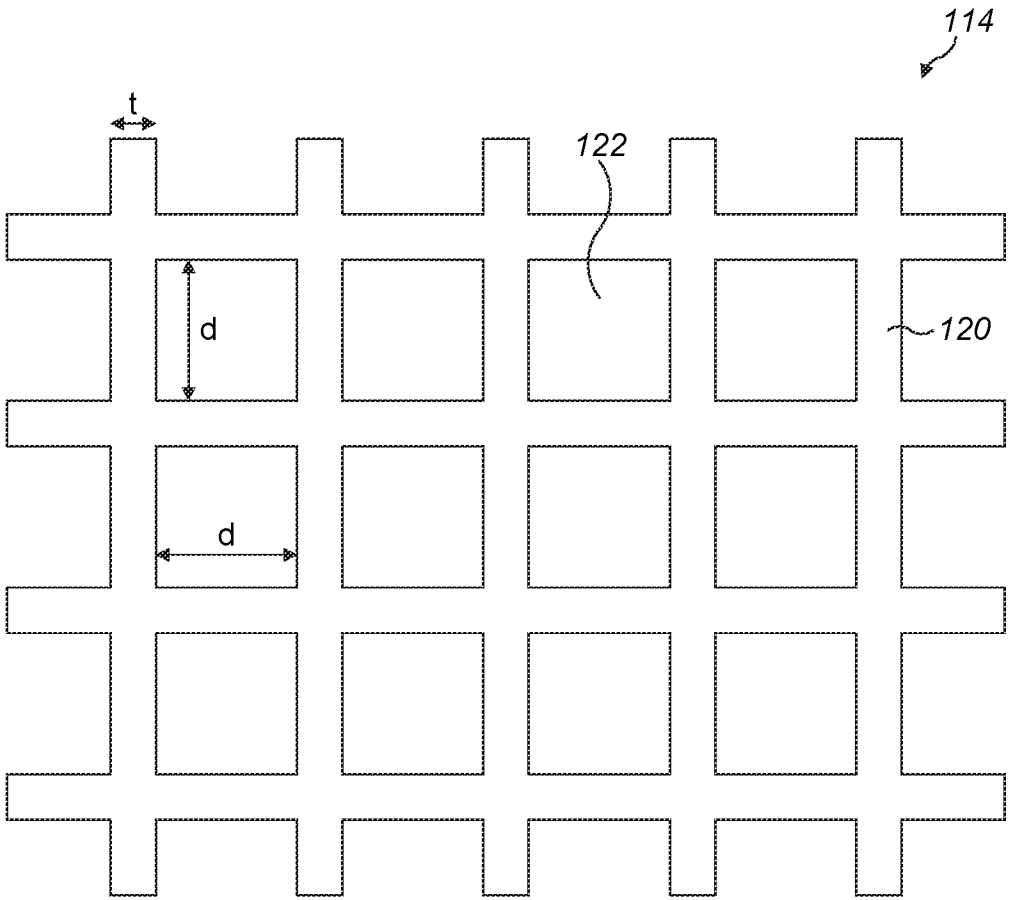
FIG. 3 is a schematic drawing of a portion of the second electrode of the example cell illustrated in FIG. 2.

As best seen in FIG. 3, the second electrode 114 may take the form of a grid or lattice. The grid or lattice may comprise electrically conductive pathways as the electrically conductive regions 120. The space between the pathways define the apertures that provide the light-transmitting regions 122. The electrically conductive pathways may comprise electrically conductive material. For instance, the electrically conductive material may be an electrically conductive pigment. The pigment may comprise metal and/or carbon. Where metal is present, the metal may be copper and/or silver. The pigment may be printed, for example, by electrophotographic printing.

The thickness of the printed pathways (t) can, by way of example, be 120 microns on average. The distance (d) between the pathways in some examples can, by way of example, be 600 microns.

The second electrode 114 may be used in place of ITO-coated substrate in an electroluminescent cell.

The electroluminescent cell 100 may be produced by electrophotographic printing. For example, the first electrode 112 may be applied to a supporting print substrate 110 by electrophotographic printing. An electrophotographic composition comprising an electrically conductive pigment may be printed on the print substrate 110 to produce the first electrode. The electrophotographic composition may also comprise thermoplastic polymer, charge adjuvant and/or charge director as described herein. Suitable electrically conductive pigments may be formed of metal and/or carbon. Where metal is present, the metal may be copper and/or silver. The electrically conductive pigment may be printed as a substantially solid layer. For example, the coverage of the electroconductive pigment of the first electrode 112 over the print substrate 110 may be substantially uniform. Multiple passes may be used to provide the required thickness of electrode 112.

A dielectric layer 118 may then be disposed over the first electrode 112. For example, the dielectric layer 118 may be applied by electrophotographic printing. An electrophotographic composition comprising dielectric material may be printed on the first electrode 112 to provide the dielectric layer 118. The electrophotographic composition may also comprise thermoplastic polymer, charge adjuvant and/or charge director as described herein. An example of a suitable dielectric material may be titanium dioxide. The dielectric material may be printed as a substantially solid layer. For example, the coverage of the dielectric material over the print substrate 110 may be substantially uniform. Multiple passes may be used to provide the required thickness of dielectric layer 118.

An electroluminescent layer 116 may be disposed over the dielectric layer 118. For example, the electroluminescent layer 116 may be applied by electrophotographic printing. An electrophotographic composition comprising electroluminescent material may be printed over the dielectric layer 118 to provide the electroluminescent layer 116. The electrophotographic composition may also comprise thermoplastic polymer, charge adjuvant and/or charge director as described herein. An example of a suitable electroluminescent material may be doped zinc sulfide. The electroluminescent material may be printed as a substantially solid layer. For example, the coverage of the electroluminescent material over the print substrate 110 may be substantially uniform. Multiple passes may be used to provide the required thickness of electroluminescent layer 116.

A second electrode 114 may be disposed over the electroluminescent layer 116. For example, the second electrode layer 114 may be applied by electrophotographic printing. An electrophotographic composition comprising electrically conductive pigment may be printed over the electroluminescent layer 116 produce the second electrode 114. The electrophotographic composition may also comprise thermoplastic polymer, charge adjuvant and/or charge director as described herein. Suitable electrically conductive pigments may be formed of metal and/or carbon. Where metal is present, the metal may be copper and/or silver. The electrophotographic composition used to form the second electrode 114 may be the same as that used to form the first electrode 112. As discussed above and shown in FIGS. 2 and 3, the electrophotographic composition may be printed in the form of a lattice or grid to provide the second electrode 114. The electrically conductive pigment may be printed as conductive pathways that provide the electrically conductive regions 120. The space between the pathways provide the light-transmitting regions 122. Multiple passes may be used to provide the required thickness of second electrode 114.

In electrophotographic printing, a latent electrophotographic image is first formed on a photoconductive surface. The photoconductive surface is then contacted with a electrophotographic composition, such that at least some of the composition adheres to the photoconductive surface to form a developed toner image on the photoconductive surface. The toner image may then be transferred to the relevant print substrate. In some examples, the toner image is transferred to the substrate via an intermediate transfer member or blanket. The intermediate transfer member or blanket may be heated to facilitate transfer of the toner image from the photoconductive surface onto the print substrate. In an alternative example, the substrate may be heated to facilitate transfer of the toner image from the photoconductive surface to the print substrate.

In an example of the method, the heating involves heating the intermediate transfer member and/or print substrate to a temperature of at least 80° C., in some examples at least 90° C., in some examples at least 100° C., in some examples at least 120° C., in some examples at least 130° C., in some examples at least 150° C., in some examples at least 180° C., in some examples at least 220° C., in some examples at least 250° C., in some examples at least 280° C. The heating may be carried out for a predetermined period, for example, of least 5 minutes, in some examples at least 10 minutes, in some examples at least 15 minutes, in some examples at least 20 minutes, in some examples at least 25 minutes, in some examples at least 30 minutes. The predetermined period may be from 5 to 60 minutes, in some examples from 15 to 45 minutes.

The photoconductive surface on which the (latent) electrophotographic image is formed or developed may be on a rotating member, e.g., in the form of a cylinder. The surface on which the (latent) electrophotographic image is formed or developed may form part of a photo imaging plate (PIP). The method may involve passing the electrophotographic composition described herein between an electrode, which may be stationary, and a rotating member, which may be a member having the surface having the (latent) electrophotographic image thereon or a member in contact with the surface having the (latent) electrophotographic image thereon. A voltage is applied between the electrode and the rotating member, such that e.g. toner particles adhere to the surface of the rotating member. The intermediate transfer member, if present, may be a rotating flexible member, which may be heated, e.g., to a temperature of from 60 to 140° C.

The print substrate 110 may be any suitable substrate. The substrate may be any suitable substrate capable of having an image printed thereon. The substrate may comprise a material selected from an organic or inorganic material. The material may comprise a natural polymeric material, e.g., cellulose. The material may comprise a synthetic polymeric material, e.g., a polymer formed from alkylene monomers, including, but not limited to, polyethylene and polypropylene, and co-polymers such as styrene-polybutadiene. In some examples, the substrate, before printing, is or comprises plastic. In some examples, the substrate, before printing, is or comprises paper. The polypropylene may, in some examples, be biaxially orientated polypropylene.

Applications

The present disclosure allows an electroluminescent cell to be produced using a digital printing process. The second electrode and, in some examples, the first electrode, electroluminescent layer and, if present, the dielectric layer, can be printed digitally, in particular using an electrophotographic printing process. This can allow the layers to be selectively printed in any particular design (e.g. in the form of a picture, letters, numbers, symbols and/or patterns) and to be very thin (i.e. each layer can have the typical thickness of a printed layer, e.g. between 1 and 20 separations thickness). The layers can be printed in the same printing process using the same printing equipment, e.g. using an electrophotographic, e.g. liquid electrophotographic, printing press (printer). The method of at least some examples of the present disclosure can be used to produce a cell that lights up when an AC voltage is applied across the first and second electrodes. The resultant cell can be durable, flexible and/or thin. The cells can be used to provide electroluminescent printed images for a very wide range of applications, such as in or on electronic equipment, toys and games, for advertisement, e.g. safety and animated signs, lighting for interior and exterior decorative purposes, for personalizing image and text prints, and for customization of clothes and accessories. The luminescent printed images, which may include writing, allow for an effective way to personalize stories or add a lighted signature to a personal gift. The cell can be flat or curved. The technology is therefore very versatile and allows mass production of electroluminescent printed devices at reasonable cost.

Various examples will now be described.

EXAMPLES

Example 1—Preparation of an Electroluminescent Electrophotographic Composition The following materials were used:

Resins (35 parts of the solids of ink composition):

Copolymer of ethylene and methacrylic supplied under the trademark Nucrel®699 (Dupont)—80 wt % of the 35 parts Copolymer of ethylene and acrylic acid supplied under the trademark A-C 5120@(Honeywell)—20% of the 35 parts Electroluminescent Material (65 Parts of the Solids of the Ink Composition):

Doped Zinc sulfide, activated—white color from Leuchtstoffwerke Breitungen GmbH. Dopants may include copper (Cu+), chlorine (Cl−), manganese (Mn 2+), silver (Ag+). Aluminium and chloride ions may act as activators.

Method

The resins at the pre-determined weight ratio were melted in iso-paraffinic solvent, Isopar-L®, under constant mixing at 140° C. in 2 L reactor. The resulting paste-like mixture was cooled (cooling rate of 0.5° C./minute) to 80° C. under constant mixing. 65 wt % of the electroluminescent material (to total mass) was added under high-shear and constant mixing.

The high-shear mixing was effective for the efficient dispersion of the electroluminescent material in the highly-viscous resin melt. After 30 minutes, the high-shear mixing was ceased and cooling was continued at a rate of 3° C./hour under constant mixing, e.g. by stirring, e.g. at 40 rpm to 100 rpm. At 60° C., the melt became a white paste. Finally, the paste was cooled down to 40° C. at 0.5° C./minute and discharged.

Charge adjuvant—aluminium stearate (VCA, available from Sigma Aldrich™) (1 wt %) was added to the paste. The mixture was lightly ground in an attritor at a low revolution rate of 120 RPM for 1 hour at 35° C. Charge director was also added (natural soya lecithin in phospholipids and fatty acids, BBP (basic barium petronate i.e. a barium sulfonate salt of a 21-26 hydrocarbon alkyl, supplied by Chemtura), and GT (dodecyl benzene sulfonic acid isopropyl amine, supplied by Croda).

Example 2—Making the Electroluminescent Cell

An electroluminescent cell in accordance with FIG. 2 was made as described below. Printing was carried out using a liquid electrophotographic printing process using in 7×00 Sheet fed HP indigo press.

In this example, the first electrode 112 is a copper-containing layer. This layer was printed using copper based conductive electrophotographic ink comprising a copper pigment onto a paper substrate (130 gsm). The number of conductive layers printed was 10 (approx. 10 μm thickness). Copper loading on the conductive layer was ~3.2 mg per cm2.

A dielectric layer 118 was then printed onto the first electrode 112. The dielectric layer was printed using a commercially available electrophotographic premium white ink comprising titanium dioxide as a pigment. The number of insulating dielectric separations (layers of print) was 10 (approx. 10 μm thickness). The amount of dielectric pigment in the dielectric layer was approximately 70 weigh %, the remainder being solid components of the electrophotographic premium white ink such as thermoplastic polymer.

An electroluminescent layer 116 was printed onto the dielectric layer 118. The electroluminescent layer 116 was printed using an electroluminescent electrophotographic composition as described in Example 1 (LFC=75 pmho). The number of separations (layers of print) was 6.

A second electrode 114 was printed on the electroluminescent layer 116. This layer was printed using the same electrophotographic composition used to print the first electrode The second electrode was printed in a grid pattern of electrically conductive pathways formed of the electrically conductive pigment (copper) shown schematically in FIG. 3. The pathways provide the electrically conductive regions 120. The thickness of the printed pathways was 120 microns on average. The gaps between the printed pathways provide the light-transmitting regions 122 of the second electrode 114. The distance between the pathways was 600 microns.

To effect electroluminescence, an AC voltage was applied across the first electrode 112 and second electrode 114. The electroluminescent material lit up when the AC voltage was applied. The light was transmitted through the second electrode 114 and was clearly visible to the naked eye. When the AC voltage was removed, electroluminescence ceased and no light was visible. The brightness of the light was measured at 3 candelas per square metre (3 cd/$m^2$).

Definitions

It is noted that, as used in this specification and the appended claims, the singular forms "a," "an," and "the" include plural referents unless the context clearly dictates otherwise.

As used in this disclosure, "carrier liquid," "carrier," or "carrier vehicle" refers to the liquid in which polymers, particles, charge directors and other additives can be dispersed to form a liquid electrophotographic composition or liquid electrophotographic composition. A mixture of a variety of different agents, such as surfactants, co-solvents, viscosity modifiers, and/or other possible ingredients may be dissolved and/or dispersed in the carrier liquid.

As used in this disclosure, "electrophotographic composition" or "electrostatic composition" generally refers to a composition, which is suitable for use in an electrophotographic or electrostatic printing process. The electrophotographic composition may comprise chargeable particles of polymer dispersed in a carrier liquid.

As used in this disclosure, "co-polymer" refers to a polymer that is polymerized from at least two monomers. The term "terpolymer" refers to a polymer that is polymerized from 3 monomers.

As used in this disclosure, "melt index" and "melt flow rate" are used interchangeably. The "melt index" or "melt flow rate" refers to the extrusion rate of a resin through an orifice of defined dimensions at a specified temperature and load, reported as temperature/load, e.g. 190° C./2.16 kg. In the present disclosure, "melt flow rate" or "melt index" is measured per ASTM D1238-04c Standard Test Method for Melt Flow Rates of Thermoplastics by Extrusion Plastometer. If a melt flow rate of a particular polymer is specified, unless otherwise stated, it is the melt flow rate for that polymer alone, in the absence of any of the other components of the electrostatic composition.

As used in this disclosure, "acidity," "acid number," or "acid value" refers to the mass of potassium hydroxide (KOH) in milligrams that neutralizes one gram of a substance. The acidity of a polymer can be measured according to standard techniques, for example as described in ASTM D1386. If the acidity of a particular polymer is specified, unless otherwise stated, it is the acidity for that polymer alone, in the absence of any of the other components of the liquid toner composition.

As used in this disclosure, "melt viscosity" generally refers to the ratio of shear stress to shear rate at a given shear stress or shear rate. Testing may be performed using a capillary rheometer. A plastic charge is heated in the rheometer barrel and is forced through a die with a plunger. The plunger is pushed either by a constant force or at constant rate depending on the equipment. Measurements are taken once the system has reached steady-state operation. One method used is measuring Brookfield viscosity@140° C., units are mPa-s or cPoise, as known in the art. Alternatively, the melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 Hz shear rate. If the melt viscosity of a particular polymer is specified, unless otherwise stated, it is the melt viscosity for that polymer alone, in the absence of any of the other components of the electrophotographic composition.

A polymer may be described as comprising a certain weight percentage of monomer. This weight percentage is indicative of the repeating units formed from that monomer in the polymer.

If a standard test is mentioned in this disclosure, unless otherwise stated, the version of the test to be referred to is the most recent at the time of filing this patent application.

As used in this disclosure, "electrostatic printing" or "electrophotographic printing" refers to the process that provides an image that is transferred from a photo imaging plate either directly or indirectly via an intermediate transfer member to a print substrate. As such, the image may not be substantially absorbed into the photo imaging substrate on which it is applied. Additionally, "electrophotographic printers" or "electrostatic printers" refer to those printers capable of performing electrophotographic printing or electrostatic printing, as described above. An electrophotographic printing process may involve subjecting the electrophotographic composition to an electric field, e.g. an electric field having a field gradient of 1-400V/μm, or more, in some examples 600-900V/μm, or more.

In some examples, the "electrophotographic printing process" can involve creating an image on a photoconductive surface, applying an ink having charged particles to the photoconductive surface, such that they selectively bind to the image, and then transferring the charged particles in the form of the image to a print substrate. The photoconductive surface may be provided on a photo imaging plate (PIP). The photoconductive surface may be selectively charged with a latent electrophotographic image having image and background areas with different potentials. For example, an electrophotographic ink composition including charged toner particles in a carrier liquid can be brought into contact with the selectively charged photoconductive surface. The charged toner particles adhere to the image areas of the latent image while the background areas remain clean. The image can be transferred to a print substrate (e.g., paper) directly or indirectly, for example, by being first transferred to an intermediate transfer member, which can be a soft swelling blanket, which is often heated to fuse the solid image and evaporate the liquid carrier, and then to the print substrate.

As used in this disclosure, "substituted" may indicate that a hydrogen atom of a compound or moiety is replaced by another atom such as a carbon atom or a heteroatom, which is part of a group referred to as a substituent. Substituents include, for example, alkyl, alkoxy, aryl, aryloxy, alkenyl, alkenoxy, alkynyl, alkynoxy, thioalkyl, thioalkenyl, thioalkynyl, thioaryl, etc.

As used in this disclosure, "heteroatom" may refer to nitrogen, oxygen, halogens, phosphorus, or sulfur.

As used in this disclosure, "alkyl", or similar expressions such as "alk" in alkaryl, may refer to a branched, unbranched, or cyclic saturated hydrocarbon group, which may, in some examples, contain from 1 to about 50 carbon atoms, or 1 to about 40 carbon atoms, or 1 to about 30 carbon atoms, or 1 to about 10 carbon atoms, or 1 to about 5 carbon atoms, for example.

The term "aryl" may refer to a group containing a single aromatic ring or multiple aromatic rings that are fused together, directly linked, or indirectly linked (such that the different aromatic rings are bound to a common group such as a methylene or ethylene moiety). Aryl groups described in this disclosure may contain, but are not limited to, from 5 to about 50 carbon atoms, or 5 to about 40 carbon atoms, or 5 to 30 carbon atoms or more, and may be selected from, phenyl and naphthyl.

Unless the context dictates otherwise, the terms "acrylic" and "acrylate" refer to any acrylic or acrylate compound. For example, the term "acrylic" includes acrylic and methacrylic compounds unless the context dictates otherwise. Similarly, the term "acrylate" includes acrylate and methacrylate compounds unless the context dictates otherwise.

As used in this disclosure, the term "about" is used to provide flexibility to a numerical range endpoint by providing that a given value may be a little above or a little below the endpoint to allow for variation in test methods or apparatus. The degree of flexibility of this term can be dictated by the particular variable and would be within the knowledge of those skilled in the art to determine based on experience and the associated description in this disclosure.

As used in this disclosure, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented in this disclosure in a range format. It is to be understood that such a range format is used merely for convenience and brevity and thus should be interpreted flexibly to include not just the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not just the explicitly recited values of about 1 wt % to about 5 wt %, but also include individual values and subranges within the indicated range. Thus, included in this numerical range are individual values such as 2, 3.5, and 4 and sub-ranges such as from 1-3, from 2-4, and from 3-5, etc. This same principle applies to ranges reciting a single numerical value. Furthermore, such an interpretation should apply regardless of the breadth of the range or the characteristics being described.

As used in this disclosure, weight % (wt %) values are to be taken as referring to a weight-for-weight (w/w) percentage of solids in the composition, and not including the weight of any carrier liquid present.

As used in this disclosure, the term "light-transmitting electrode layer" is an electrode layer that comprises electrically conductive regions interspersed by light-transmitting regions. The light-transmitting regions have higher light-transmissivity than the electrically conductive regions. The light-transmitting regions may have higher light-transmissivity than the electrically conductive regions in at least the visible and/or infrared region of the electromagnetic spectrum. The light-transmitting regions may have higher light-transmissivity than the electrically conductive regions in at least in the visible spectrum. The light-transmitting regions may have higher light-transmissivity of wavelengths of 380 nm to 1 mm than the electrically conductive regions. The light-transmitting regions may have higher light-transmissivity of wavelengths of 380 nm to 750 nm, for example, 380 to 700 nm than the electrically conductive regions. The light-transmitting regions may be optically transparent or optically translucent, for example, allowing the transmission of at least 50%, at least 60%, at least 70%, at least 80%, at least 85%, at least 90%, at least 95% or 100% of incident light through the light-transmitting regions. In some examples, the light transmitting regions may be defined by apertures or voids that act as windows through which incident light generated by the electroluminescent layer can be transmitted. The incident light may be infrared and/or visible light generated by the electroluminescent layer. The incident light may be the light generated by the electroluminescent layer. The incident light may have a wavelength of 380 nm to 1 mm, for example, 380 nm to 750 nm or 380 nm to 700 nm. The electrically conductive regions have a lower light-transmissivity than the light-transmitting regions. The electrically conductive regions may be opaque, for example, blocking the transmission of at least 60%, at least 70%, at least 80%, at least 85%, at least 90%, at least 95% or 100% of incident light through the electrically conductive regions. As noted above, the incident light may be the light generated by the electroluminescent layer. The incident light may have a wavelength of 380 nm to 1 mm, for example, 380 nm to 750 nm or 380 to 700 nm. The electrically conductive regions may absorb wavelengths in the visible spectrum, i.e. wavelengths from 380 nm to 750 nm or 380 to 700 nm.

It is to be understood that this disclosure is not limited to the particular process steps and materials disclosed in this disclosure because such process steps and materials may vary. It is also to be understood that the terminology used in this disclosure is used for the purpose of describing particular examples. The terms are not intended to be limiting because the scope is intended to be limited by the appended claims and equivalents thereof.

The invention claimed is:

1. An electroluminescent cell, comprising:

a first electrode;

a second electrode; and an electroluminescent layer disposed between the first electrode and the second electrode, wherein the second electrode defines electrically conductive regions and light-transmitting regions interspersed among the electrically conductive regions with the electrically conductive regions formed from an electrophotographic composition including a thermoplastic polymer and an electrically conductive pigment, and wherein the light-transmitting regions have a higher light-transmissivity compared to the electrically conductive regions.

2. The electroluminescent cell as claimed in claim 1, wherein the electrically conductive regions include a charge director, a charge adjuvant, or a combination thereof.

3. The electroluminescent cell as claimed in claim 1, wherein a ratio of a total area of the light-transmitting regions to a total area of the electrically conductive regions is at least 30%.

4. The electroluminescent cell as claimed in claim 1, wherein the light-transmitting regions are apertures.

5. The electroluminescent cell as claimed in claim 4, wherein the electrically conductive regions define a reticulated network of electrically conductive pathways with the apertures defined between adjacent pathways.

6. The electroluminescent cell as claimed in claim 5, wherein the reticulated network is a grid.

7. The electroluminescent cell as claimed in claim 5, wherein each of the electrically conductive pathways is 60 μm to 200 μm wide with adjacent pathways spaced 200 μm to 1000 μm.

8. The electroluminescent cell as claimed in claim 1, wherein the first electrode comprises the thermoplastic polymer and the electrically conductive pigment.

9. The electroluminescent cell as claimed in claim 1, further comprising a light-transmitting layer of a conductive polymer in electrical contact with the second electrode.

10. The electroluminescent cell as claimed in claim 1, further comprising a dielectric layer disposed between the electroluminescent layer and the first electrode.

11. The electroluminescent cell as claimed in claim 1, wherein the second electrode abuts the electroluminescent layer.

12. The electroluminescent cell as claimed in claim 1, wherein the electrically conductive regions are in direct contact with the electroluminescent layer.

13. The electroluminescent cell as claimed in claim 1, wherein the light-transmitting regions are apertures extending through the second electrode and open to the electroluminescent layer.

14. The electroluminescent cell as claimed in claim 1, wherein the electrically conductive pigment is present in an amount of from 50 wt % to 70 wt %, based on a total weight of the electrophotographic composition.

15. The electroluminescent cell as claimed in claim 1, wherein the thermoplastic polymer is present in an amount of from 1 wt % to 15 wt %, based on a total weight of solids of the electrophotographic composition.

16. A method of making an electroluminescent cell, the method comprising:

forming a first electrode;

disposing an electroluminescent layer over the first electrode; and forming a second electrode over the electroluminescent layer by electrophotographically printing an electrophotographic composition including a thermoplastic polymer and an electrically conductive pigment, the second electrode defining electrically conductive regions that are formed from the electrophotographic composition, wherein light-transmitting regions are interspersed among the electrically conductive regions and the light-transmitting regions having a higher light-transmissivity compared to the electrically conductive regions.

17. The method as claimed in claim 16, wherein the electroluminescent layer is disposed over the first electrode by electrophotographically printing the electrophotographic composition.

18. The method as claimed in claim 16, wherein the first electrode is formed by electrophotographically printing the electrophotographic composition onto a print substrate.

* * * * *